US007686873B2

(12) United States Patent
Kawatani

(10) Patent No.: US 7,686,873 B2
(45) Date of Patent: Mar. 30, 2010

(54) AIR CLEANER IN ALL TERRAIN VEHICLE

(75) Inventor: Shinji Kawatani, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 954 days.

(21) Appl. No.: 11/455,103

(22) Filed: Jun. 19, 2006

(65) Prior Publication Data

US 2007/0012274 A1 Jan. 18, 2007

(30) Foreign Application Priority Data

Jun. 23, 2005 (JP) ..... 2005-183794

(51) Int. Cl.
*B01D 46/00* (2006.01)

(52) U.S. Cl. ..... 96/420; 55/385.3; 123/585; 123/198 E

(58) Field of Classification Search ..... 55/385.3, 55/523, DIG. 10, DIG. 30, DIG. 34; 95/273, 95/278; 96/417, 421, 420; 60/311, 295, 60/297, 300; 123/585, 198 E; 137/625.31, 137/599, 115.13; 251/61.2, 63, 63.6, 249.5, 251/318

See application file for complete search history.

(56) References Cited

U.S. PATENT DOCUMENTS 4,319,896 A * 3/1982 Sweeney ..... 96/401
6,640,794 B2 * 11/2003 Weber ..... 123/585
6,694,727 B1 * 2/2004 Crawley et al. ..... 60/295
7,147,693 B2 * 12/2006 Inoue et al. ..... 95/273
7,153,342 B2 * 12/2006 Koga et al. ..... 95/20
2008/0098701 A1 * 5/2008 Takeshima et al. ..... 55/385.3
2009/0120046 A1 * 5/2009 Huff ..... 55/290

FOREIGN PATENT DOCUMENTS

JP 2001-349242 A 12/2001

* cited by examiner

*Primary Examiner*—Duane Smith
*Assistant Examiner*—Minh-Chau T Pham
(74) *Attorney, Agent, or Firm*—Birch, Stewart, Kolasch & Birch, LLP

(57) ABSTRACT

An air cleaner is provided in an all terrain vehicle in order to improve the control performance for effecting optimal combustion in an engine by accurately measuring the temperature of air introduced into the engine. The air cleaner includes an air cleaner case disposed behind an engine, a throttle valve disposed between the engine and the air cleaner case, and connecting tube for connecting the air cleaner case and the throttle valve with each other. A temperature sensor is disposed in either a front or rear face of the air cleaner case. Optionally, the temperature sensor is disposed in the connecting tube.

16 Claims, 8 Drawing Sheets

AIR CLEANER IN ALL TERRAIN VEHICLE

CROSS-REFERENCE TO RELATED APPLICATION

The present application claims priority under 35 U.S.C. §119 to Japanese Patent Application No. 2005-183794, filed Jun. 23, 2005, the entire contents of which are hereby incorporated by reference.

BACKGROUND OF THE INVENTION

1. Field of the Invention

The present invention relates to an air cleaner in an all terrain vehicle for running on rough roads such as a four-wheel buggy.

2. Description of Background Art

With the recent tendency to an electronic control in vehicles there has been developed a technique wherein the temperature of air introduced into an engine is measured and the amount of air to be introduced at a low or high temperature is adjusted to effect appropriate combustion (see, for example, Japanese Patent Laid-Open No. 2001-349242).

More particularly, there has been proposed a technique wherein temperature measuring means for measuring the temperature of air introduced into an engine is attached to an air cleaner case adjacent to an upper portion of the engine to effect an electronic control.

However, in the case where the temperature measuring means and the engine are adjacent to each other, the temperature of the temperature measuring means itself may be increased by radiant heat from the engine, thus making it difficult to measure an accurate temperature of air introduced into the engine. Moreover, it is necessary that a mounting portion for mounting the temperature measuring means be formed in the air cleaner.

SUMMARY AND OBJECTS OF THE INVENTION

For solving the above-mentioned problems it is an object of the present invention to provide an air cleaner in an all terrain vehicle which air cleaner can be formed in a simple manner while improving the control performance for effecting optimal combustion of an engine by accurately measuring the temperature of air introduced into the engine.

For achieving the above-mentioned object, according to a first aspect of the present invention, an air cleaner provided in an all terrain vehicle includes an air cleaner case disposed behind and engine, a throttle valve disposed between the engine and the air cleaner case, and a connecting tube for connecting the air cleaner case and the throttle valve with each other. In addition, a temperature sensor is disposed in either a front or a rear of the air cleaner case.

According to a second aspect of the present invention, an air cleaner in an all terrain vehicle also includes an exhaust pipe disposed on one side of a longitudinal center line of the air cleaner case and wherein the temperature sensor is disposed on the other side of the longitudinal center line of the air cleaner case.

According to a third aspect of the present invention, a first mounting hole for fixing the connecting tube, a second mounting hole for fixing a snorkel duct which is for introducing air into the air cleaner case, and a third mounting hole for fixing the temperature sensor, are formed in either the front or the rear.

According to a fourth aspect of the present invention, an air cleaner in an all terrain vehicle includes an air cleaner case disposed behind an engine, a throttle valve disposed between the engine and the air cleaner case, and a connecting tube for connecting the air cleaner case and the throttle valve with each other, characterized in that a temperature sensor is disposed in the connecting tube.

According to the first aspect of the present invention, since the temperature sensor for measuring the temperature of air introduced into the engine is disposed in either the front or rear of the air cleaner case which is disposed behind the engine, it is possible to measure the temperature of air without being influenced by radiant heat from the engine. Consequently, in comparison with an air cleaner wherein the temperature sensor is disposed in a side portion of the air cleaner case, it is not necessary to ensure a temperature sensor mounting space between the side portion of the air cleaner case and a frame to support the side portion, so that not only it is possible to ensure a sufficient capacity of the air cleaner case, but also the control performance for effecting optimal combustion of the engine can be improved by accurately measuring the temperature of air introduced into the engine with use of the temperature sensor.

According to the second aspect of the present invention, since the temperature sensor is disposed on the other side of the exhaust pipe with respect to the longitudinal center line of the air cleaner case and hence can be positioned away from the exhaust pipe, the temperature sensor becomes difficult to be influenced by a high temperature of the exhaust pipe, whereby an erroneous measurement of the temperature sensor caused by the heat of the exhaust pipe is prevented and it is possible to measure the intake air temperature accurately.

According to the third aspect of the present invention, since the first mounting hole for fixing the connecting tube, the second mounting hole for fixing the snorkel duct which is for introducing air into the air cleaner case, and the third mounting hole for fixing the temperature sensor, are formed in either the front or the rear, the first, second and third mounting holes can be formed in either the front or the rear of the air cleaner case simultaneously in the same process. For that reason, it is possible to make a subsequent step or the like unnecessary and improve the productivity.

According to the fourth aspect of the present invention, since the temperature sensor for measuring the temperature of air introduced into the engine is disposed in the connecting tube for connecting the air cleaner case and the throttle valve with each other, the air temperature can be measured without being influenced by radiant heat of the engine, so that the control performance for effecting optimal combustion of the engine can be improved by accurately measuring the temperature of air introduced into the engine with use of the temperature sensor. Moreover, in case of attaching the temperature sensor to the air cleaner case, since the air cleaner case is made of resin, it is necessary to mount the temperature sensor through an elastic member, with a consequent increase in the number of parts. However, since the connecting tube also serves as the elastic member, the temperature sensor can be attached directly to the connecting tube and hence it is possible to decrease the number of parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7 is an exploded perspective view illustrating an assembly relation of parts in and around an air cleaner in an all terrain vehicle according to a third embodiment of the present invention; and.

DETAILED DESCRIPTION OF THE PREFERRED EMBODIMENTS

Figure 1:
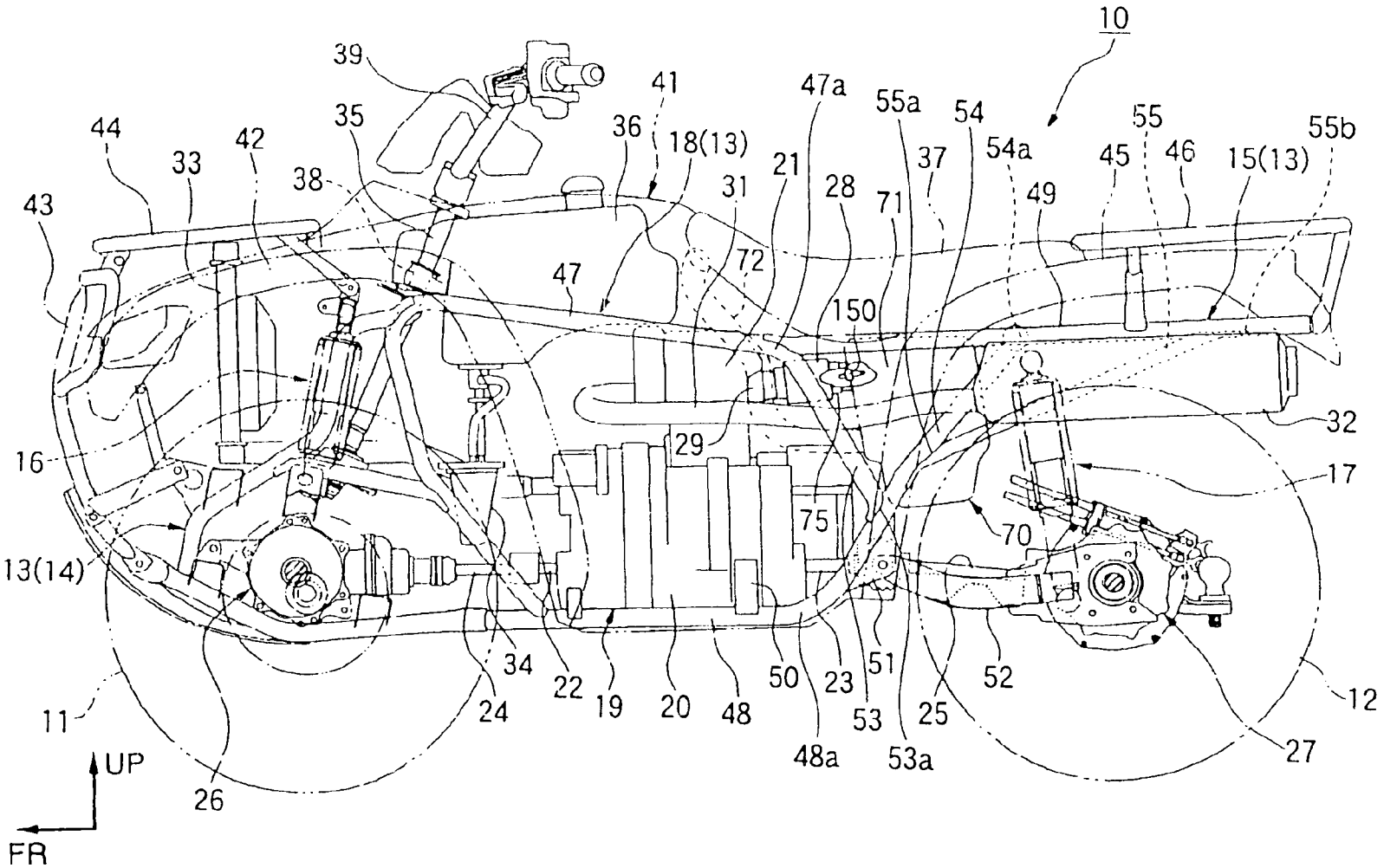
FIG. 1 is a side view of an all terrain vehicle which carries thereon an air cleaner according to a first embodiment of the present invention.

It is assumed that directions such as front, rear and right, left directions in the following descriptions are the same as directions in the vehicle unless otherwise mentioned. In the drawings, the arrows FR, LH, and UP represent front, left, and upper sides, respectively, of the vehicle.

FIGS. 1 to 5 illustrate a first embodiment of the present invention.

The front and rear wheels 11, 12 are low pressure balloon tires of a relatively large diameter and are disposed on front and rear sides, respectively, of a vehicle body which is constituted as a small-sized and light-weight body. With the front and rear wheels 11, 12, a minimum road clearance is ensured large to improve the running-through performance mainly on rough roads. Each front wheel 11 and each rear wheel 12 are suspended through a front suspension 16 and a rear suspension 17, respectively, in a front frame 14 and a rear frame 15 as constituents of a body frame 13.

A center frame 18 is disposed nearly centrally of the body frame 13 and an engine 19 as a prime mover is mounted on the center frame 18. The engine 19 is, for example, a water-cooled type single-cylinder reciprocating engine and is disposed longitudinally with a rotational axis of a crank shaft extending in the longitudinal direction of the vehicle. The engine 19 has a construction wherein a cylinder head 21 is erected on a crank case 20. A front output shaft 22 and a rear output shaft 23 are drawn out longitudinally forward and backward from front and rear portions, respectively, of the crank case 20 at positions offset to the left side with respect to the transversely central position of the vehicle body.

The output shafts 22 and 23 are connected to each front wheel 11 and each rear wheel 12 through a front propeller shaft 24, a rear propeller shaft 25 and a front final reduction gear unit 26, a rear final reduction gear unit 27, so that the output from the engine 19 is transmitted to each front wheel 11 and each rear wheel 12 through a transmission (not shown) installed within the crank case 20, then through the output shafts 22 and 23 and further through the propeller shafts 24, 25 and the final reduction gear units 26, 27.

A rear portion of the cylinder head 21 in the engine 19 and a throttle valve unit 28 are connected together through an intake manifold 29 and a rear portion of the throttle valve unit 28 and a front portion of an air cleaner case 71 which constitutes an air cleaner 70 are connected together through a connecting tube 75. A snorkel duct 72 is connected to the front portion of the air cleaner case 71. The snorkel duct 72 is open in the upper portion of the vehicle body which portion is not influenced by radiant heat from the engine 19. Further, a temperature sensor 150 is attached to the front portion of the air cleaner case 71.

An exhaust pipe 31 is connected to a front portion of the cylinder head 21. The exhaust pipe 31 extends ahead of the cylinder head 21, then turns back and extends backward while passing the left side of the cylinder head 21, then a front end thereof is connected to a muffler 32 disposed in the rear portion of the vehicle body. A radiator 33 for cooling the engine 19 is disposed in front of the front suspensions 16 and a fuel pump 34 for feeding fuel under pressure to an injector (not shown) is disposed in front of the engine 19.

Centrally in the transverse direction of the vehicle body there are disposed a steering shaft 35, a fuel tank 36 and a saddle-ride type seat 37 in this order from the front side. A lower end of the steering shaft 35 is connected to a front wheel steering mechanism (not shown) through a head pipe 38 which is disposed near a front end of the front frame 14, and a bar handle 39 is mounted to an upper end of the steering shaft 35. The all terrain vehicle 10 undergoes strong reactions from front, rear and right, left during travel and therefore, in order to facilitate control of the vehicle, an accelerator mechanism (not shown) connected to the throttle valve unit 28 is independently provided at a separate position without being installed within a rotatable grip such as a right grip 40.

In a front portion of the body frame 13 there are mounted a body cover 41 made of resin and which covers the front portion of the vehicle body, front fenders 42 made of resin and which cover upper and rear portions of the front wheels 11, a front protector 43 formed mainly by steel, and a front carrier 44. In a rear portion of the body frame 13 there are mounted rear fenders 45 made of resin which cover upper and front portions of the front wheels 12 and a rear carrier 46 formed mainly by steel.

The body frame 13 is an integral combination of plural types of steels joined together by welding for example. A box-like closed loop structure which is longitudinally long centrally in the transverse direction of the vehicle body is formed using right and left upper pies 47 and lower pipes 48 and by connecting those pipes with use of plural cross members.

Each of the upper pipes 47 is somewhat inclined backwardly downward at an upper and outside position of the body frame 13 and a rear portion 47*a* thereof has an inclined portion 53 which is inclined backwardly downward. At the rear portion 47*a* the upper pipes 47 are connected to seat frames 49. Each of the lower pipes 48 is disposed nearly horizontally at a lower outside position of the body frame 13 and a rear portion 48*a* thereof has a rising portion 54. A rear end portion 54*a* of the rising portion 54 is connected to a nearly central part of the associated seat frame 49. A rear end portion 53*a* of the inclined portion 53 of each upper pipe 47 is connected to a nearly central position of the rising portion 54 of the associated lower pipe 48. A rear sub-pipe 55 is connected at a front end portion 55*a* thereof to a nearly central position of the rising portion 54 and rises gently backward. A rear end portion 55*b* of the rear sub-pipe 55 is connected to a rear position of the associated seat frame 49. Further, right and left steps 50 are fixed to central positions of the lower pipes 48. That is, the air cleaner 70 is disposed below the seat frames 49, behind the inclined portions 53 of the upper pipes 47 and sideways of the rising portions 54 of the lower pipes 48.

Figure 3:
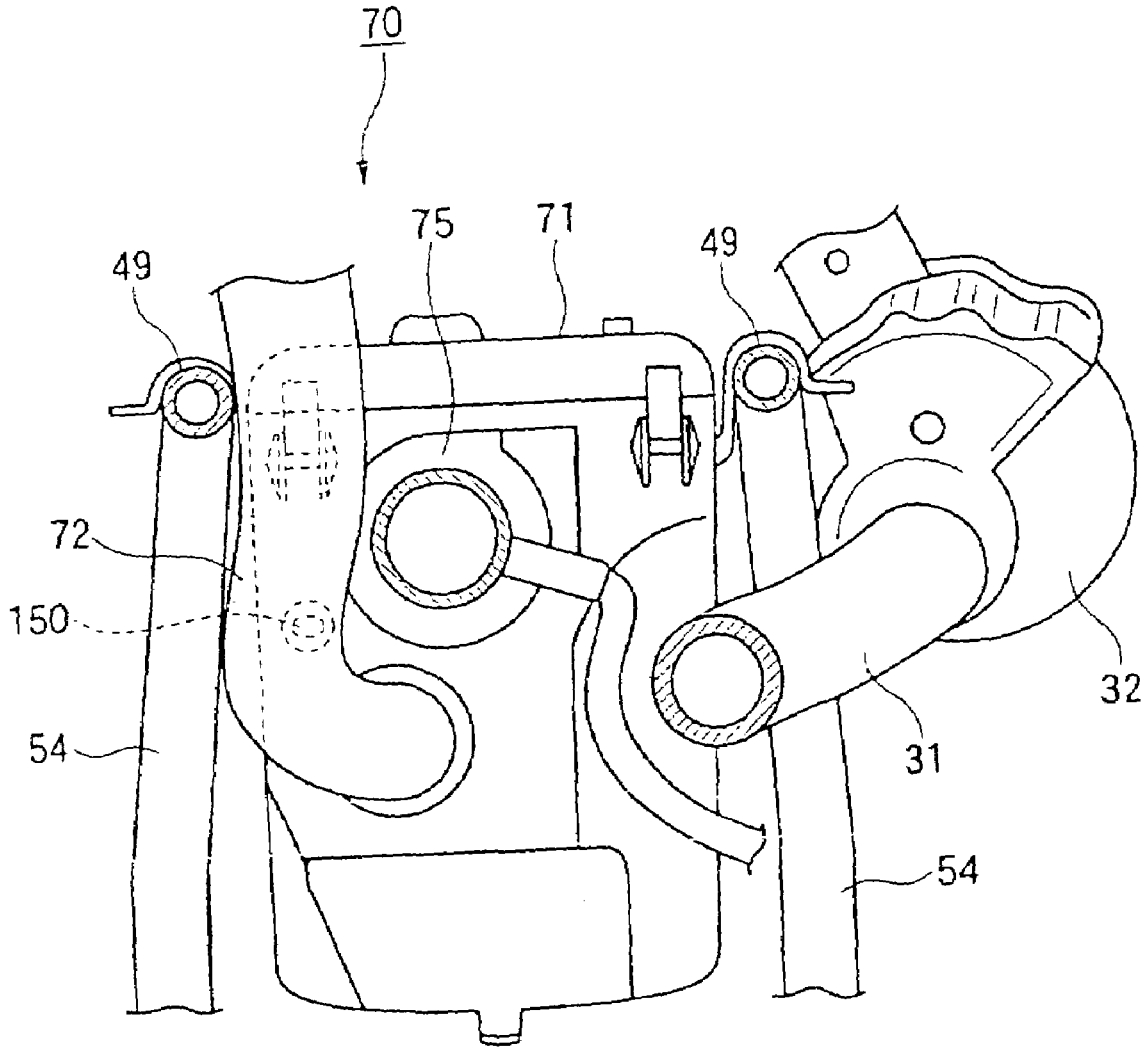
FIG. 3 is a front view of the air cleaner shown in FIG. 1.

As shown in FIG. 3, when the air cleaner 70 is seen from the front side, with respect to the air cleaner case 71 disposed between the pair of right and left seat frames 49 and the rising portions 54 of the lower pipes 48, the exhaust pipe 31 is disposed inside the body frame 13 up to the rear of an inclined portion 53, then is curved so as to bypass the right side portion in the figure of the air cleaner case 71, then is further curved outside the body frame 13 from the front of a rising portion 54 and is connected to the muffler 32.

The temperature sensor 150 is disposed at a position where it overlaps with the curved snorkel duct 72 and thus the influence thereon of radiant heat from the engine 19 can be avoided.

Right and left swing arm support portions 51 which are longitudinally flat and generally triangular are integrally provided at rear lower portions of the upper pipes 47 respectively and swing arms 52 with the rear final reduction gear unit 27 fixed thereto are pivotably connected to the swing arm support portions 51 respectively.

Figure 4:
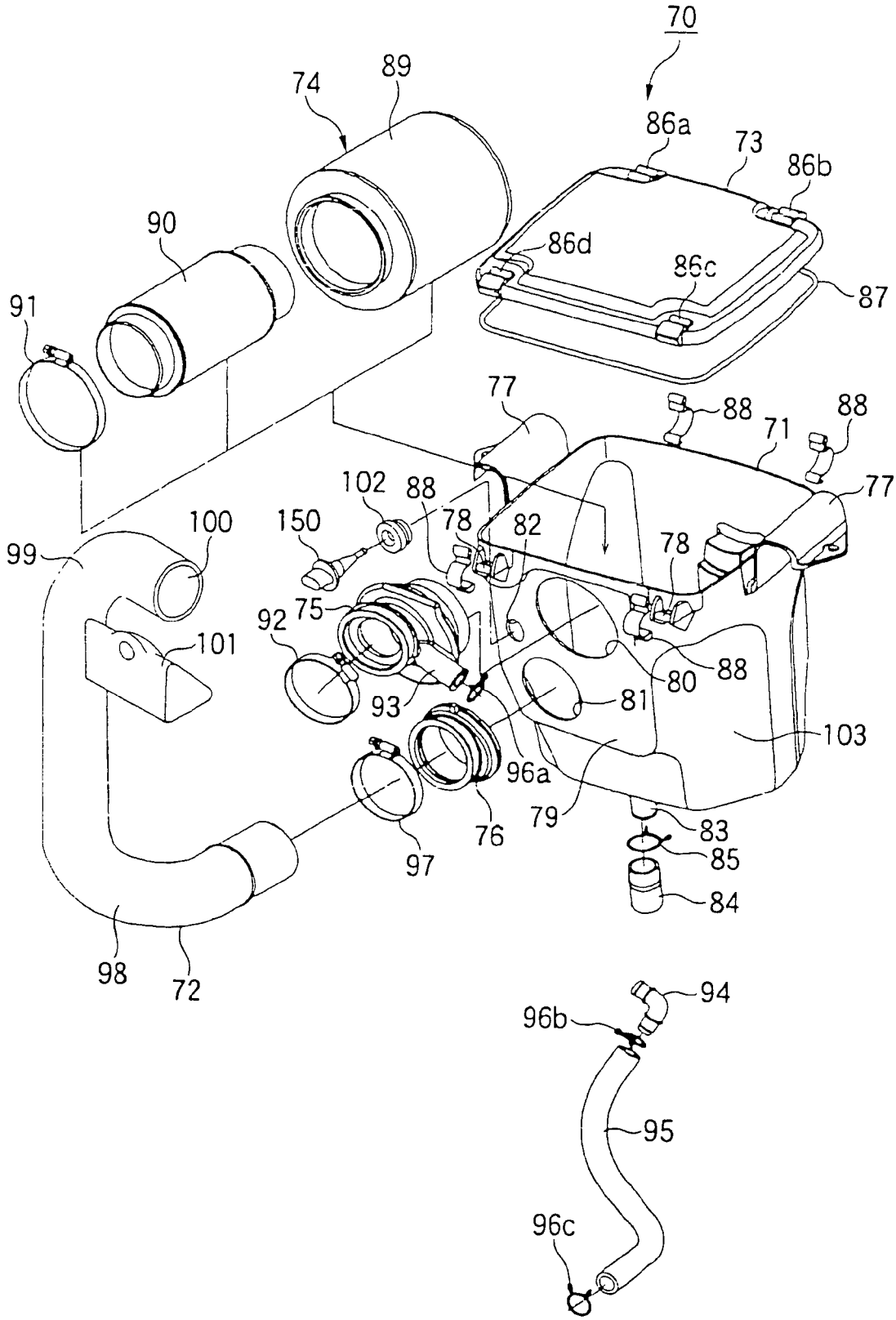
FIG. 4 is an exploded perspective view illustrating an assembly relation of parts in and around the air cleaner installed on the all terrain vehicle of FIG. 1.

FIG. 4 illustrates the air cleaner 70. As shown in the same figure, the air cleaner 70 is mainly composed of air cleaner case 71, lid 73, element 74, connecting tube 75, snorkel tube 76, snorkel duct 72 and temperature sensor 150.

The air cleaner case 71 is made of resin and its upper portion is open. The air cleaner case 71 has inverted U-shaped seat frame-side support portions 77 to be mounted bridgewise on the seat frames 49 respectively at opposed upper-end positions and also has two pairs of lid fixing hooks 78 at opposed upper-end positions. The air cleaner case 71 is further provided a front 79 thereof with a first mounting hole 80 for fixing the connecting tube 75, a second mounting hole 81 for fixing the snorkel tube 76, and a third mounting hole 82 for fixing the temperature sensor 150. A drain hose 84 is connected to a drain hole 83 formed in the bottom of the air cleaner case 71 and is fixed by a hose band 85.

The lid 73 is formed in a plate shape which covers an upper opening of the air cleaner case 71 and is provided at its four corners with retaining portions 86*a*, 86*b*, 86*c* and 86*d*. With a seal member 87 sandwiched in between the lid 73 and an upper end portion of the air cleaner case 71, four binders 88 are engaged with the hooks 78 of the air cleaner case 71 on one side and with the retaining portions 86*a*, 86*b*, 86*c*, 86*d* of the lid 73 on the other side, whereby the lid 73 is integrally secured to the air cleaner case 71 to ensure a water-tight condition.

The element 74 includes a cylindrical element body 89 closed at an end portion thereof and a cylindrical body 90. Within the air cleaner case 71, the body 90 with the element body 89 mounted thereto is inserted into the connecting tube 75 and a hose band 91 is fitted on the connecting tube 75, whereby the element 74 is mounted to the air cleaner case 71 in a state in which the interior thereof is connected to the interior of the connecting tube 75. The element 74 filters the air introduced into the air cleaner case 71 and supplies it to the intake manifold 29 (see FIG. 1).

The connecting tube 75 is formed in a cylindrical shape using an elastic material, e.g., rubber. One end portion of the connecting tube 75 is fitted in the first mounting hole 80 of the air cleaner case 71, while an opposite end portion thereof is connected to the throttle valve unit 28 (see FIG. 1) and then a hose band 92 is fitted thereon, whereby the air cleaner case 71 is connected to the throttle valve unit 28. The connecting tube 75 is centrally provided with a breather tube 93 of a cylindrical shape. The breather tube 93 is brought into communication with a breather hose 95 through an L-shaped joint 94 and is fixed by hose bands 96*a*, 96*b* and 96*c*.

The snorkel tube 76 is formed in a cylindrical shape using an elastic material, e.g., rubber. One end portion of the snorkel tube 76 is fitted in the second mounting hole 81 of the air cleaner case 71, while an opposite end portion thereof is connected to the snorkel duct 72 and then a hose band 97 is fitted thereon, whereby the air cleaner case 71 is connected to the snorkel duct 72.

The snorkel duct 72 is a tubular member made of resin and having a predetermined effective length. The snorkel duct 72 includes successively from the snorkel tube 76 side a main portion 98 which extends obliquely upward toward the front side of the vehicle body at a nearly uniform passage sectional area and a bent portion 99 which is bent at a front end of the main portion 98. An air inlet 100 provided in a front end of the bent portion 99 is open sideways to make the entry of water and dust difficult. The snorkel duct 72 has an expansion chamber 101 at an intermediate position to expand the passage sectional area of the main portion 98 abruptly, whereby the air flow resistance is lowered to prevent the generation of pulsation noise and intake noise of the air cleaner 70 can be deadened by the resonator function of the expansion chamber 101. The snorkel duct 72 itself is difficult to absorb heat and therefore it is bent around the temperature sensor 150, whereby the propagation of heat to the temperature sensor 150 can be prevented.

The temperature sensor 150, which is a thermistor, is fitted in the third mounting hole 82 of the air cleaner case 71 through a grommet 102. The temperature sensor 150 measures the temperature of intake air introduced into the air cleaner case 71 and provides a measured electric signal to an engine control unit (not shown). In accordance with temperature information in the interior of the air cleaner case 71 the engine control unit makes control to correct the air-fuel ratio when the air density changes due to a change in intake air temperature and a consequent change of oxygen content.

Figure 5:
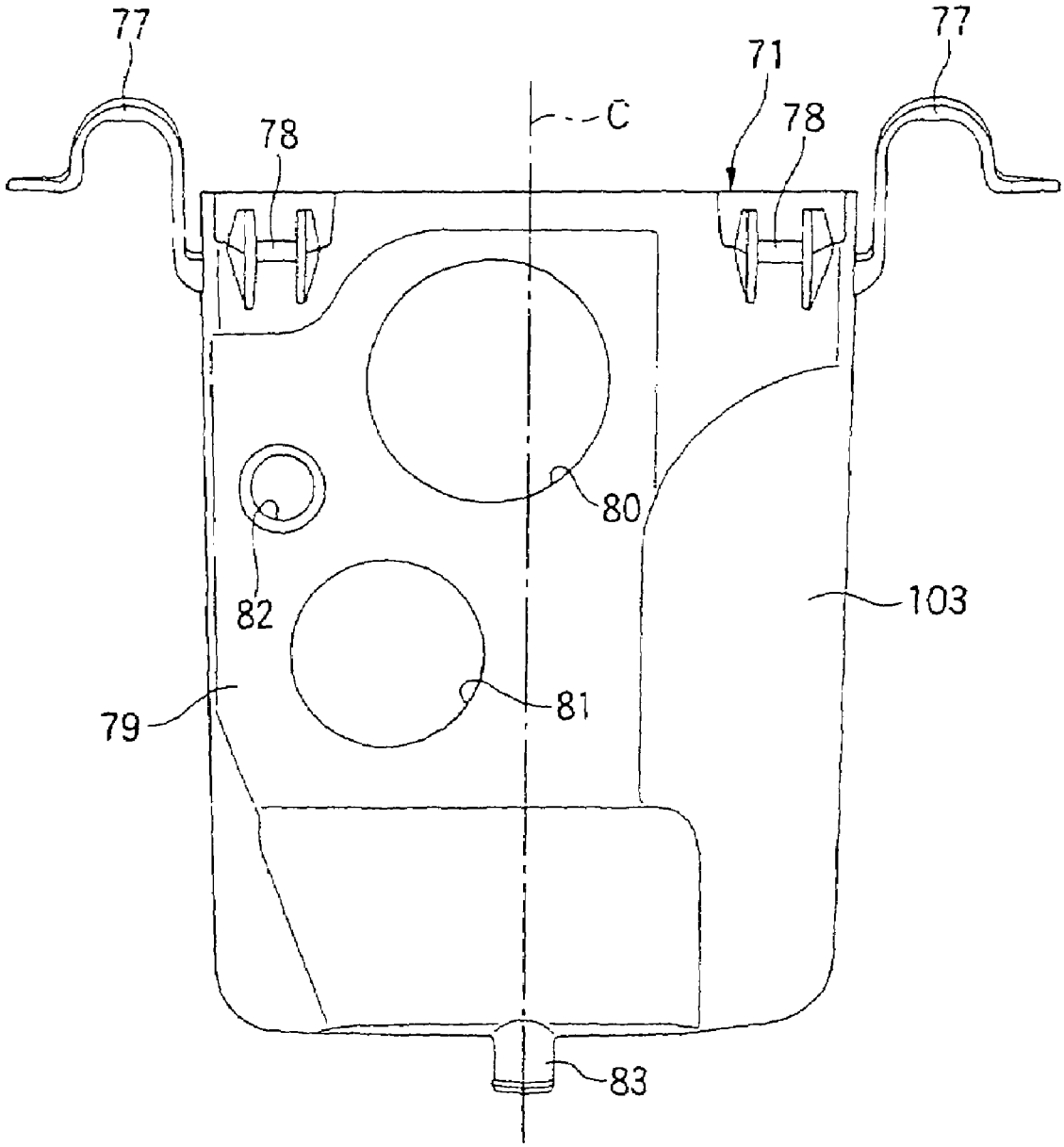
FIG. 5 is a front view of an air cleaner case alone used in the air cleaner shown in FIG. 4.

As shown in FIG. 5, the air cleaner case 71 is provided in its front 79 with the first, second and third mounting holes 80, 81, 82, so that the portion for mounting the snorkel duct 72, the portion for mounting the connecting tube 75 and the portion for mounting the temperature sensor 150 can be formed by molding simultaneously in the same process. Thus, it is possible to make a subsequent step or the like unnecessary.

Figure 2:
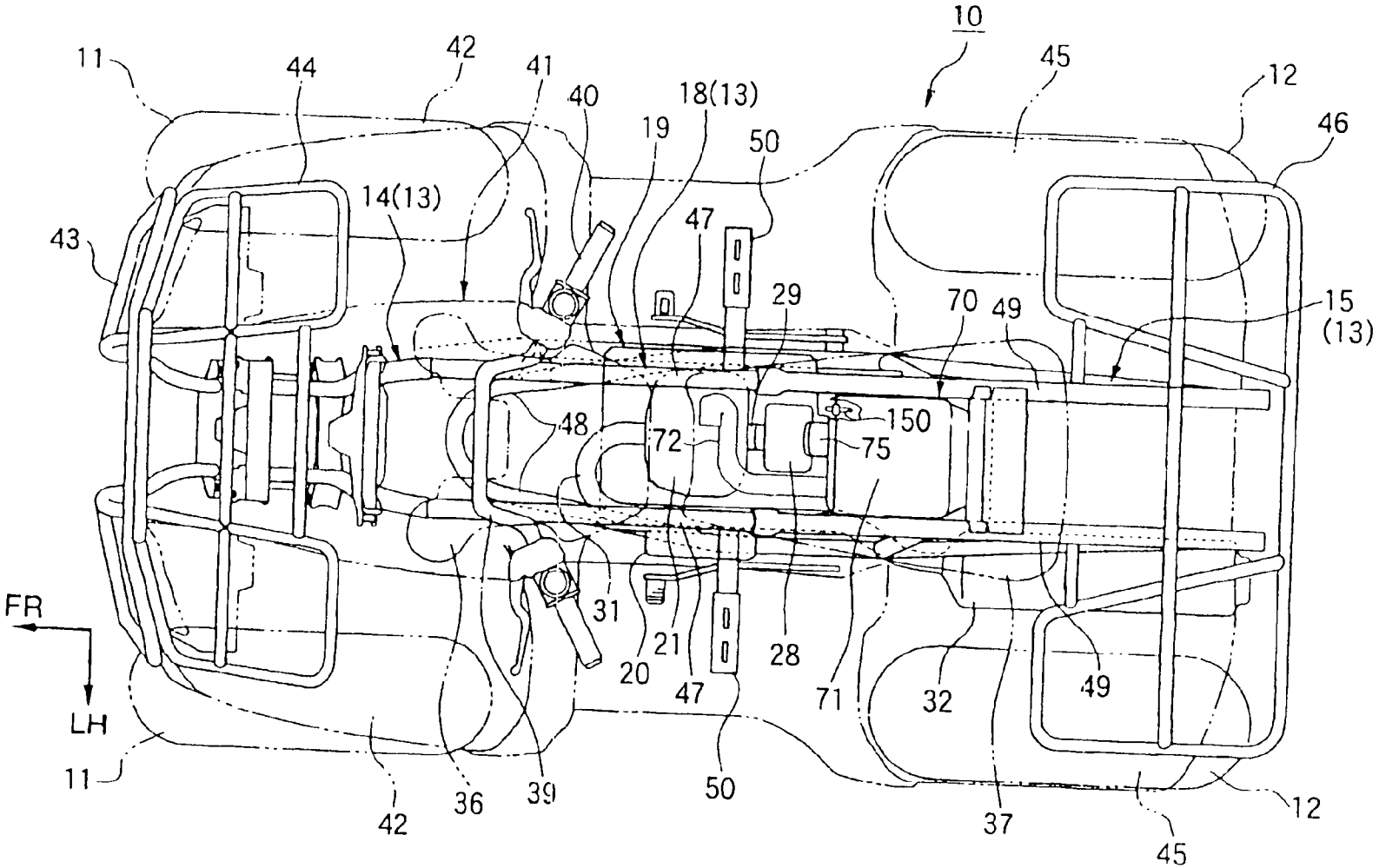
FIG. 2 is a plan view of the all terrain vehicle shown in FIG. 1.

On the right side with respect to a longitudinal center line C (a longitudinal center line of the vehicle body) the air cleaner case 71 has a recess 103 for heat relief from the exhaust pipe 31 (see FIG. 2). In the air cleaner case 71, the first, second and third mounting holes 80, 81, 82 are positioned on the left side with respect to the longitudinal center line C which side is opposite to the side where the recess 103 is formed. By thus disposing the temperature sensor 150 away from the exhaust pipe 31, the temperature sensor 150 becomes difficult to be influenced by the high temperature of the exhaust pipe 31 and hence an erroneous measurement caused by the heat of the exhaust pipe 31 is prevented.

In the air cleaner 70 of the all terrain vehicle 10 thus constructed, the seat frame-side support portions 77 are connected bridgewise to the seat frames 49 and are locked with clips to brackets (not shown) projecting outward from the seat frames 49. The element 74 installed within the air cleaner case 71 is connected to the throttle valve unit 28 through the connecting tube 75, the lid 73 is secured to the air cleaner case 71, the air cleaner case 71 is connected to the snorkel duct 72 through the snorkel tube 76, and the temperature sensor 150 is attached to the air cleaner case 71 and is mounted on the vehicle body. Thus, the temperature sensor 150 is disposed in the front 79 of the air cleaner case 71 disposed behind the engine 19 and behind the throttle valve unit 28 which is disposed between the engine 19 and the air cleaner case 71.

Upon start-up of the engine 19, the temperature of the air present within the air cleaner case 71 is measured by the temperature sensor 150 and a measured electric signal is provided to the engine control unit, which in turn makes control to correct the air-fuel ratio in accordance with a change in intake temperature.

In the air cleaner 70 of the all terrain vehicle 10 according to the first embodiment of the present invention described above, since the temperature sensor 150 for measuring the temperature of air introduced into the engine 19 is disposed in the front 79 of the air cleaner case 71 which is disposed behind the engine 19, the air temperature can be measured without being influenced by radiant heat from the engine 19. Thus, in comparison with the construction in which the temperature sensor is disposed sideways of the air cleaner case 71, it is not necessary to ensure a temperature sensor mounting space between the air cleaner case 71 and the seat frame which supports the side portion of the air cleaner case 71. Consequently, not only it is possible to ensure a sufficient capacity of the air cleaner case 71, but also the control performance for effecting optimal combustion in the engine 19 can be improved by accurately measuring the temperature of air introduced into the engine 19 with use of the temperature sensor 150.

In the air cleaner 70 of the all terrain vehicle 10 according to this embodiment, since the temperature sensor 150 is disposed on the other side of the exhaust pipe 31 with respect to the longitudinal center line C of the air cleaner case 71, it can be positioned away from the exhaust pipe 31 and is therefore difficult to be influenced by the high temperature of the exhaust pipe 31. As a result, the temperature sensor 150 is prevented from making an erroneous measurement caused by the heat of the exhaust pipe 31 and can measure the intake air temperature accurately.

In the air cleaner 70 of the all terrain vehicle 10 according to this embodiment, since the snorkel duct 72 for introducing air into the air cleaner case 71 is connected to the same front 79 to which the temperature sensor 150 and the connecting tube 75 are also connected, the portion for mounting the snorkel duct 72, the portion for mounting the temperature sensor 150, and the portion for mounting the connecting tube 75 can be formed by molding in the air cleaner case 71 simultaneously in the same process, whereby it is possible to make a subsequent step or the like unnecessary and improve the productivity.

In the air cleaner 70 of the all terrain vehicle 10 according to this embodiment, since the all terrain vehicle 10 is an all terrain vehicle (ATV), even if it is used in a severe condition such as running on an rough road or running at high speed, the control performance for effecting optimal combustion in the engine 19 can be improved by accurately measuring the temperature of air introduced into the engine 19 with use of the temperature sensor 150 and it is thereby possible to ensure a high quality over a long period.

Figure 6:
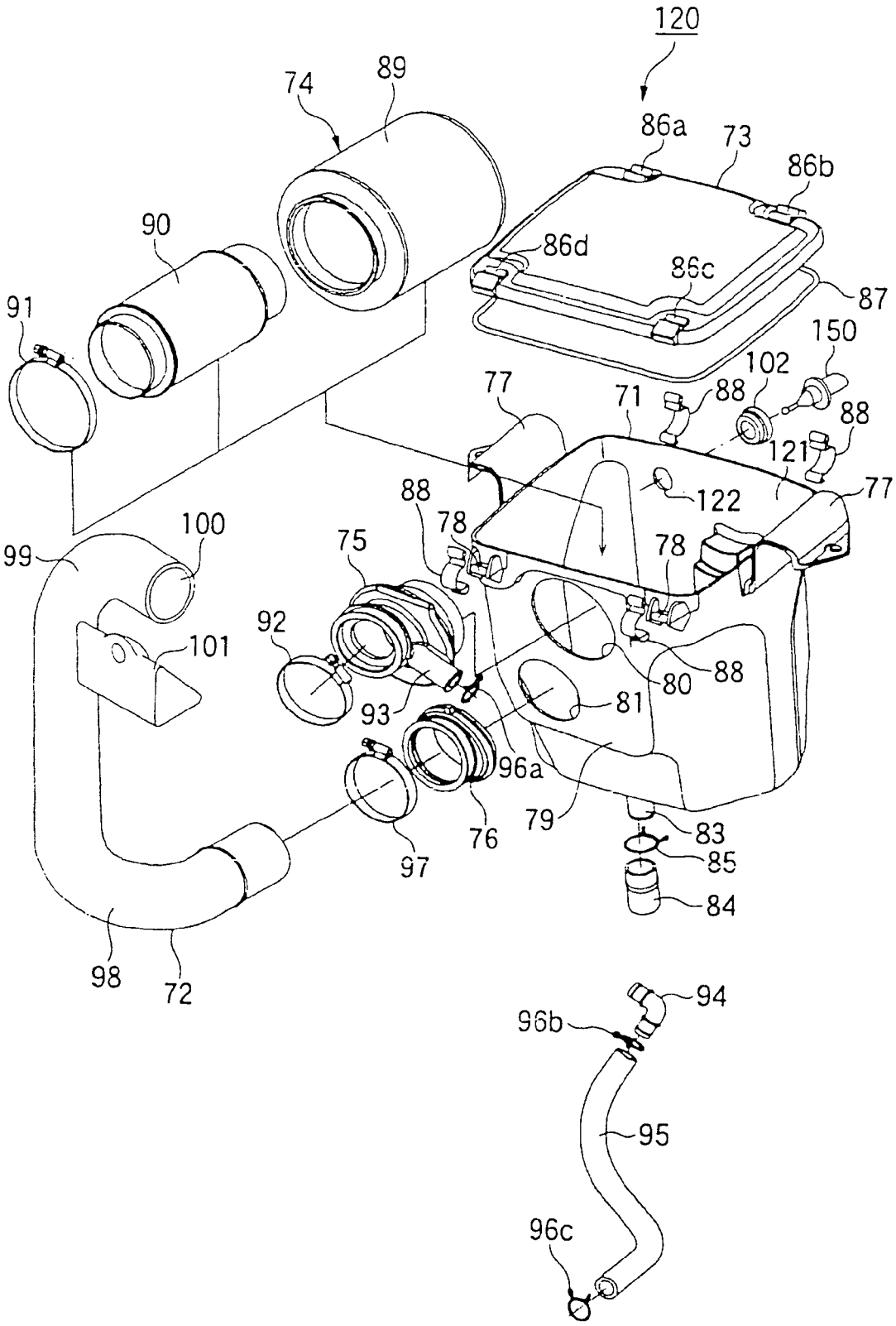
FIG. 6 is an exploded perspective view illustrating an assembly relation of parts in and around an air cleaner in an all terrain vehicle according to a second embodiment of the present invention.

Next, an air cleaner in the all terrain vehicle according to a second embodiment of the present invention will be described below with reference to FIG. 6. FIG. 6 is an exploded perspective view illustrating an assembly relation of parts in and around the air cleaner of the second embodiment. In the same figure, portions same as or equal to those in the first embodiment are identified by the same reference numerals as in the first embodiment, and explanations thereof will be omitted or simplified.

As shown in FIG. 6, an air cleaner 120 in the all terrain vehicle 10 is provided in a rear 121 of the air cleaner case 71 with a mounting hole 122 for fixing the temperature sensor 150. The temperature sensor 150 is fitted through the grommet 101 into the mounting hole 122 formed in the rear 121 of the air cleaner case 71.

In the air cleaner case 120 of the all terrain vehicle 10, the temperature sensor 150 is mounted in the rear 121 of the air cleaner case 71 disposed behind the engine 19 and behind the throttle valve unit 28 which is disposed between the air cleaner case 71 and the engine 19. With this arrangement, upon start-up of the engine 19, the temperature of the air present within the air cleaner case 71 is measured by the temperature sensor 150 and a measured electric signal is provided to the engine control unit, which in turn makes control to correct the air-fuel ratio in accordance with a change in intake air temperature.

In the air cleaner 120 of the all terrain vehicle 10 according to this second embodiment, since the temperature sensor 150 for measuring the temperature of air introduced into the engine 19 is mounted in the rear face 121 of the air cleaner case 71 which is disposed behind the engine 19, the temperature air can be measured without being influenced by radiant heat from the engine 19. Consequently, not only it is possible to ensure a sufficient capacity of the air cleaner case 71, but also the control performance for effecting optimal combustion of the engine 19 can be improved by accurately measuring the temperature of air introduced into the engine 19 with use of the temperature sensor 150.

Figure 7:
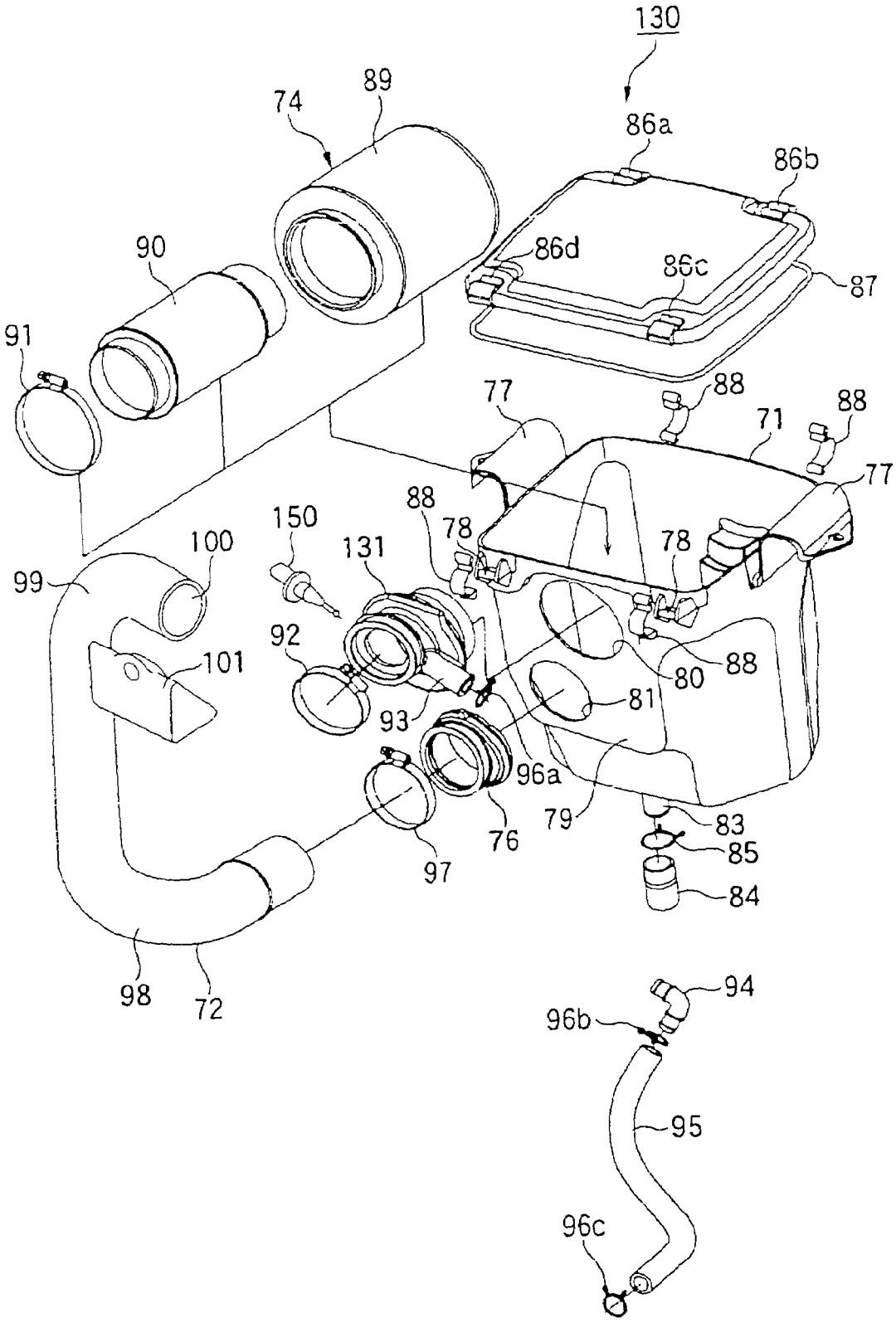
Figure 8:
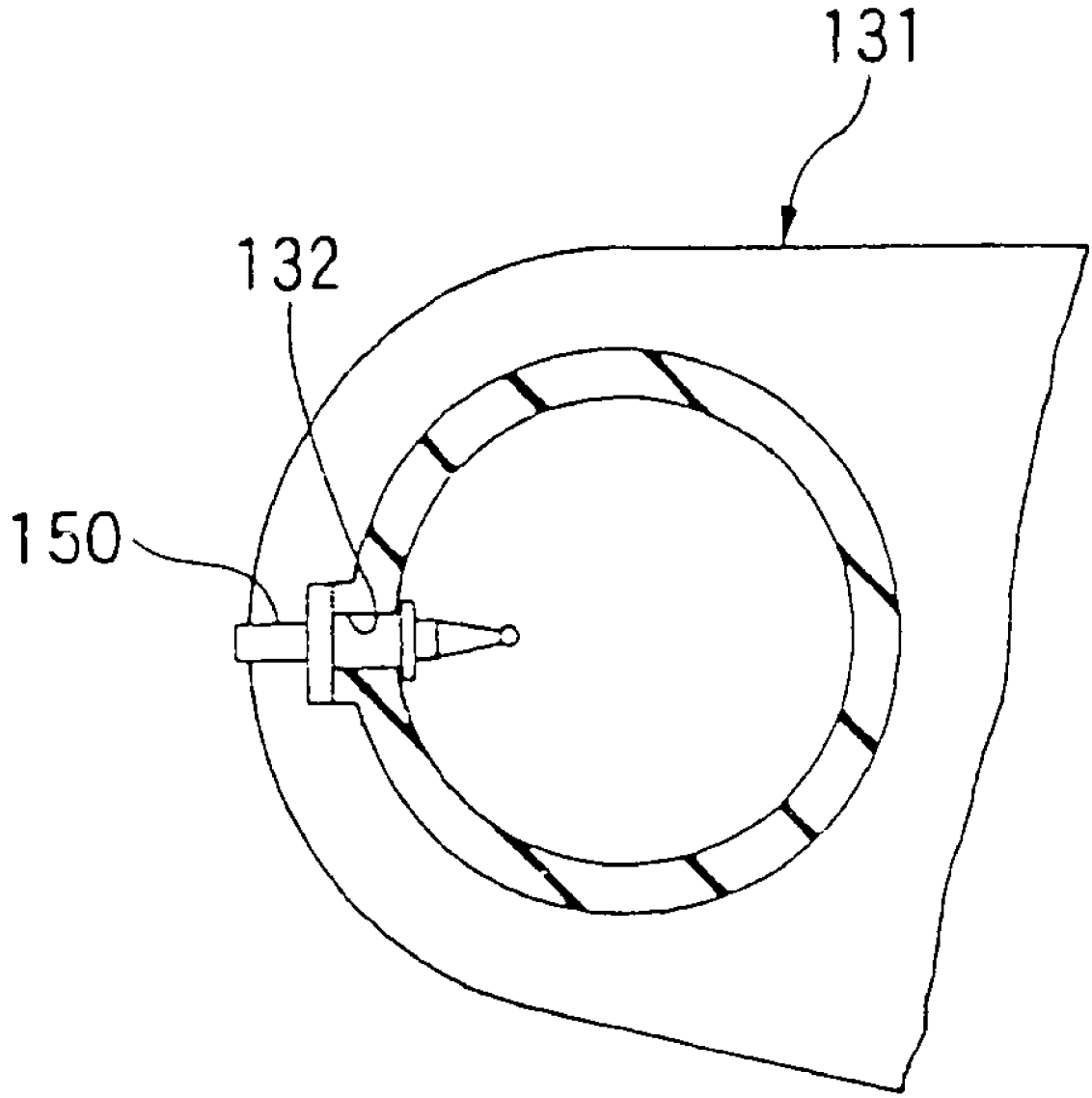
FIG. 8 is a sectional view of a connecting tube in the air cleaner shown in FIG. 7.

Next, an air cleaner in an all terrain vehicle according to a third embodiment of the present invention will be described below with reference to FIGS. 7 and 8. FIG. 7 is an exploded perspective view illustrating an assembly relation of parts in and around the air cleaner of the third embodiment and FIG. 8 is a sectional view of a connecting tube used in the air cleaner of FIG. 7. In both figures, portions same as or equal to those in the first embodiment are identified by the same reference numerals as in the first embodiment, and explanations thereof will be omitted or simplified.

In an air cleaner 130 of the all terrain vehicle 10 according to this third embodiment, as shown in FIG. 7, the temperature sensor 150 is attached to a connecting tube 131 which is for connecting the air cleaner case 71 and the throttle valve 28 with each other.

As shown in FIG. 8, like the connecting tube 75 shown in FIG. 4, the connecting tube 131 is formed in a cylindrical tube using an elastic material such as rubber for example and is provided in an intermediate position of the cylindrical portion with a sensor mounting hole 132 which extends inwards through the cylindrical portion. The temperature sensor 150 is directly fitted in the sensor mounting hole 132 of the connecting tube 131. Thus, the temperature sensor 150 is attached to the air cleaner case 71 directly without intervention of a mounting member such as grommet.

As in the first embodiment, the temperature sensor 150 is disposed at a position overlapping the snorkel duct 72 and hence it is possible to avoid influence of the radiant heat from the engine 19.

In the air cleaner 130 of the all terrain vehicle 10 according to this third embodiment, the temperature sensor 150 is mounted in the connecting tube 131 on the front face 79 of the air cleaner case 71 disposed behind the engine 19 and behind the throttle valve unit 28 which is disposed between the air cleaner case 71 and the engine 19. With this arrangement, upon start-up of the engine 19, the temperature of the air present within the air cleaner case 71 is measured by the temperature sensor 150 and a measured electric signal is provided to the engine control unit, which in turn makes control to correct the air-fuel ratio in accordance with a change in intake air temperature.

In this air cleaner 130 of the all terrain vehicle 10 according this third embodiment, since the temperature sensor 150 for measuring the temperature of air introduced into the engine 19 is disposed in the connecting tube 131 which is for connecting the air cleaner case 71 and the throttle valve unit 28 with each other, the air temperature can be measured without being influenced by radiant heat from the engine 19 and hence the control performance for effecting optimal combustion in the engine 19 can be improved by accurately measuring the temperature of air introduced into the engine 19 with use of the temperature sensor 150.

In the air cleaner 130 of the all terrain vehicle 10 according this third embodiment, the air cleaner case 71 is made of resin, so at the time of mounting the temperature sensor 150 to the air cleaner case 71, it is necessary to use an elastic member, e.g., grommet, as an intervenient member, with a consequent increase in the number of parts. However, since the connecting tube 131 also servers as the elastic member, the temperature sensor 150 can be mounted directly to the connecting tube 131, whereby it is possible to decrease the number of parts.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air cleaner in an all terrain vehicle, comprising:
an air cleaner case disposed behind an engine;
a throttle valve disposed between said engine and said air cleaner case; and
a connecting tube for connecting said air cleaner case and said throttle valve with each other;
wherein a temperature sensor is disposed in a front of said air cleaner case,
wherein a first mounting hole for fixing said connecting tube, a second mounting hole for fixing a snorkel duct which is introducing air into said air cleaner case, and a third mounting hole for fixing said temperature sensor are formed in the front of the air cleaner case.

2. The air cleaner in an all terrain vehicle according to claim 1, further comprising:
an exhaust pipe disposed on one side of a longitudinal center line (C) of said air cleaner;
wherein said temperature sensor is disposed on the other side of said longitudinal center line (C) of said air cleaner case.

3. The air cleaner in an all terrain vehicle according to claim 1, wherein the air cleaner case is made of resin.

4. The air cleaner in an all terrain vehicle according to claim 1, wherein the temperature sensor is disposed in a grommet in the third mounting hole in the front of said air cleaner case.

5. The air cleaner in an all terrain vehicle according to claim 1, further comprising:
a recess formed on one side of a longitudinal center line (C) of said air cleaner case;
wherein said temperature sensor is disposed on the other side of said longitudinal center line (C) of said air cleaner case.

6. An air cleaner in an all terrain vehicle, comprising:
an air cleaner case disposed behind an engine;
a throttle valve disposed between said engine and said air cleaner case;
a connecting tube for connecting said air cleaner case and said throttle valve with each other; and
a recess formed on one side of a longitudinal center line (C) of said air cleaner case;
wherein said temperature sensor is disposed on the other side of said longitudinal center line (C) of said air cleaner case,
wherein a temperature sensor is disposed in a rear of said air cleaner case.

7. The air cleaner in an all terrain vehicle according to claim 6, further comprising:
an exhaust pipe disposed on the one side of the longitudinal center line (C) of said air cleaner;
wherein said temperature sensor is disposed on the other side of said longitudinal center line (C) of said air cleaner case.

8. The air cleaner in an all terrain vehicle according to claim 6, wherein a first mounting hole for fixing said connecting tube and a second mounting hole for fixing a snorkel duct which is introducing air into said air cleaner case are formed in a front of the air cleaner case, and a third mounting hole for fixing said temperature sensor is formed in the rear of the air cleaner case.

9. The air cleaner in an all terrain vehicle according to claim 7, wherein a first mounting hole for fixing said connecting tube and a second mounting hole for fixing a snorkel duct which is introducing air into said air cleaner case are formed in a front of the air cleaner case, and a third mounting hole for fixing said temperature sensor is formed in the rear of the air cleaner case.

10. The air cleaner in an all terrain vehicle according to claim 6, wherein the air cleaner case is made of resin.

11. The air cleaner in an all terrain vehicle according to claim 8, wherein the temperature sensor is disposed in a grommet in the third mounting hole in the rear of said air cleaner case.

12. An air cleaner in an all terrain vehicle, comprising:
an air cleaner case disposed behind an engine;
a throttle valve disposed between said engine and said air cleaner case;
a connecting tube for connecting said air cleaner case and said throttle valve with each other; and
an exhaust pipe disposed on one side of a longitudinal center line (C) of said air cleaner;
wherein said temperature sensor is disposed on the other side of said longitudinal center line (C) of said air cleaner case,
wherein a temperature sensor is disposed in said connecting tube.

13. The air cleaner in an all terrain vehicle according to claim 12, wherein a first mounting hole for fixing said connecting tube and a second mounting hole for fixing a snorkel duct which is introducing air into said air cleaner case are formed in a front of the air cleaner case, and a sensor mounting hole for directly fixing said temperature sensor is formed in a side of the connecting tube.

14. The air cleaner in an all terrain vehicle according to claim 12, wherein a first mounting hole for fixing said connecting tube and a second mounting hole for fixing a snorkel duct which is introducing air into said air cleaner case are formed in a front of the air cleaner case, and a sensor mounting hole for directly fixing said temperature sensor is formed in a curved side of the connecting tube.

15. The air cleaner in an all terrain vehicle according to claim 12, wherein a sensor mounting hole for directly fixing said temperature sensor is formed on one side of the connecting tube, the one side being opposite to a breather tube.

16. The air cleaner in an all terrain vehicle according to claim 12, further comprising:

a recess formed on the one side of the longitudinal center line (C) of said air cleaner case;

wherein said temperature sensor is disposed on the other side of said longitudinal center line (C) of said air cleaner case.

* * * * *